US005870882A

United States Patent [19]

Lowe

[11] Patent Number: 5,870,882

[45] Date of Patent: Feb. 16, 1999

[54] SYSTEM FOR AUTOMATICALLY OPENING CARTONS AND REMOVING PACKAGES THEREIN

[75] Inventor: Byron L. Lowe, Macon, Ga.

[73] Assignee: Brown & Williamson Tobacco Corporation, Louisville, Ky.

[21] Appl. No.: 824,508

[22] Filed: Mar. 26, 1997

[51] Int. Cl.[6] ..... B65B 43/26

[52] U.S. Cl. ..... 53/381.2; 53/544; 414/412

[58] Field of Search ..... 53/381.2, 381.1, 53/544; 414/412; 209/616, 629, 660, 680, 654, 684

[56] References Cited

U.S. PATENT DOCUMENTS

| | | | |
|---|---|---|---|
| 3,386,320 | 6/1968 | Pinkham et al. . | |
| 3,763,557 | 10/1973 | Sewell . | |
| 4,036,380 | 7/1977 | Berry et al. . | |
| 4,083,499 | 4/1978 | Thatcher . | |
| 4,543,029 | 9/1985 | Grun et al. . | |
| 4,622,875 | 11/1986 | Emery et al. . | |
| 4,798,508 | 1/1989 | Lewis | 53/381.2 |
| 4,843,801 | 7/1989 | Roncero | 53/381.2 |
| 4,867,179 | 9/1989 | Leonard . | |
| 5,001,951 | 3/1991 | Eisenlohr et al. . | |
| 5,086,790 | 2/1992 | Greene, Jr. . | |
| 5,117,843 | 6/1992 | Holmes et al. . | |
| 5,144,789 | 9/1992 | Focke et al. | 53/381.2 |
| 5,165,219 | 11/1992 | Sekiguchi et al. | 53/544 |
| 5,234,007 | 8/1993 | Holmes et al. . | |
| 5,275,295 | 1/1994 | Eisenlohr et al. | 209/654 |
| 5,275,523 | 1/1994 | Stewart et al. . | |
| 5,476,354 | 12/1995 | Crain et al. | 53/381.2 |

FOREIGN PATENT DOCUMENTS

| | | | |
|---|---|---|---|
| 2157593 | 10/1985 | United Kingdom | 209/660 |

*Primary Examiner*—James F. Coan
*Assistant Examiner*—Gene L. Kim
*Attorney, Agent, or Firm*—Middleton & Reutlinger; John F. Salazar; Charles I. Sherman

[57] ABSTRACT

A system for automatically opening cartons and removing packages therefrom includes a centrifugal orientation bowl for orientating closed or unopened cartons in a position to be fed to a slitting apparatus. The slitting apparatus includes a pair of cutters therein to cut opposed portions of the cartons thereby opening the cartons. A carton breaker is utilized downstream from the slitting apparatus to break the cartons open thereby loosening the packages therefrom. The opened cartons are fed to a rotating drum separator wherein the packages within the cartons are separated from the cartons and the emptied cartons are removed from the rotating drum separator in one location and the packages separated from the cartons are removed at another location.

9 Claims, 3 Drawing Sheets

SYSTEM FOR AUTOMATICALLY OPENING CARTONS AND REMOVING PACKAGES THEREIN

BACKGROUND OF THE INVENTION

This invention relates to a system for automatically opening cartons containing packages therein and removing the packages from the cartons and more particularly for a system for opening cartons and removing packages of cigarettes from the cartons.

In the manufacturing of cigarettes, cigarettes are packaged in packages generally containing twenty cigarettes per package and each package is then placed into a carton, each carton generally containing ten packs of cigarettes. Retail outlets for these cigarettes in many instances do not open the cartons but keep the cartons stacked on storeroom shelves and sell the cigarettes by the carton. However, shelf life of cigarettes within the cartons is a relatively short period of time, generally less than three months, and if the carton of cigarettes is not purchased within that period of time, the cartons are returned to the manufacturers where the cartons are opened, the packages are removed and the cigarettes removed from the packages so that the tobacco which is relatively expensive, may then be reprocessed and re-used. Thus, means to economically open the cartons and remove the packages therefrom is an important consideration for cigarette manufacturers.

The prior art has a number of systems and devices available for the opening of the packages of cigarettes and removing the cigarettes therefrom but in many instances the opening of the cartons to remove the packages from the cartons in a tobacco recovery process is generally labor intensive.

SUMMARY OF THE INVENTION

An object of the present invention is to provide a system for the opening of cartons, particularly packages of cigarettes, and remove the packages therefrom in an economical and efficient manner.

Another object of this invention is to provide apparatus for aligning cartons of cigarettes and opening said cartons.

Even another object of this invention is to provide an apparatus for separating packages from an opened carton.

A further object of this invention is to provide a system for removing packages from opened and unopened cartons either simultaneously or selectively.

More particularly, the present invention provides a system for automatically opening cartons and removing packages from the cartons comprising: a carton orientation means with a first conveying means to feed cartons to said carton orientation means; second conveying means for removal of cartons from the carton orientation means; carton opening means in cooperating relation with said second conveying means; third conveyor means downstream from said second conveyor means and in flow communication with second conveyor means; and, a rotatable drum positioned to receive product from said third conveying means, said rotating drum including means to separate packages from opened cartons.

Further objects and advantages of this invention will become apparent from the following description and appended claims, reference being had to the accompanying drawings forming a part of the specification wherein like reference characters designate corresponding parts into several views.

DETAILED DESCRIPTION OF THE DRAWINGS

DETAILED DESCRIPTION OF THE PREFERRED EMBODIMENT

Figure 1:
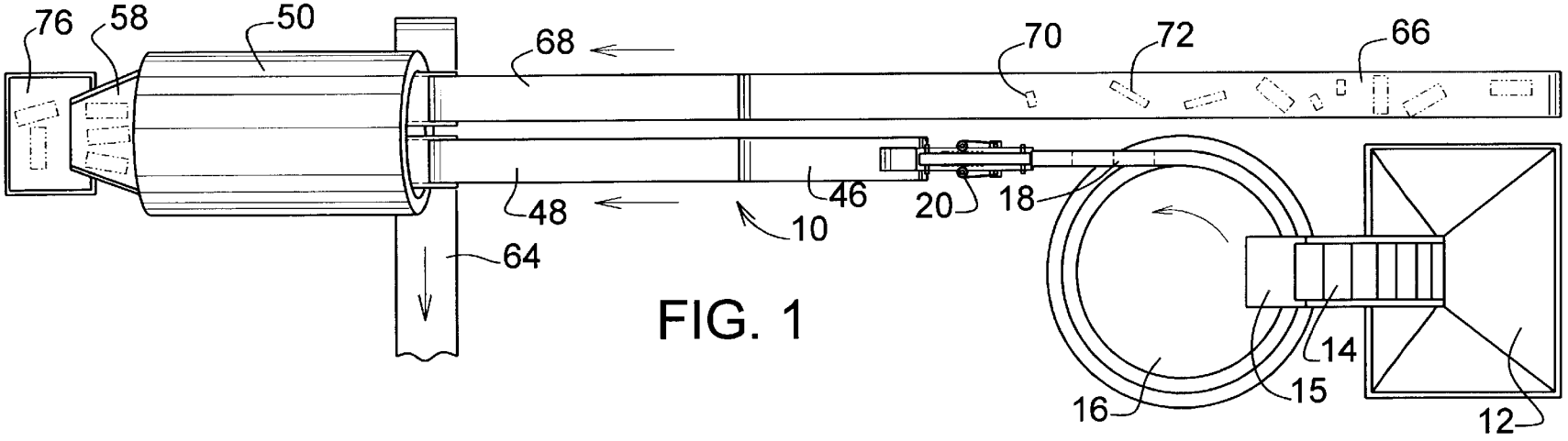
FIG. 1 is a top view of a preferred embodiment of the present invention.
Figure 2:
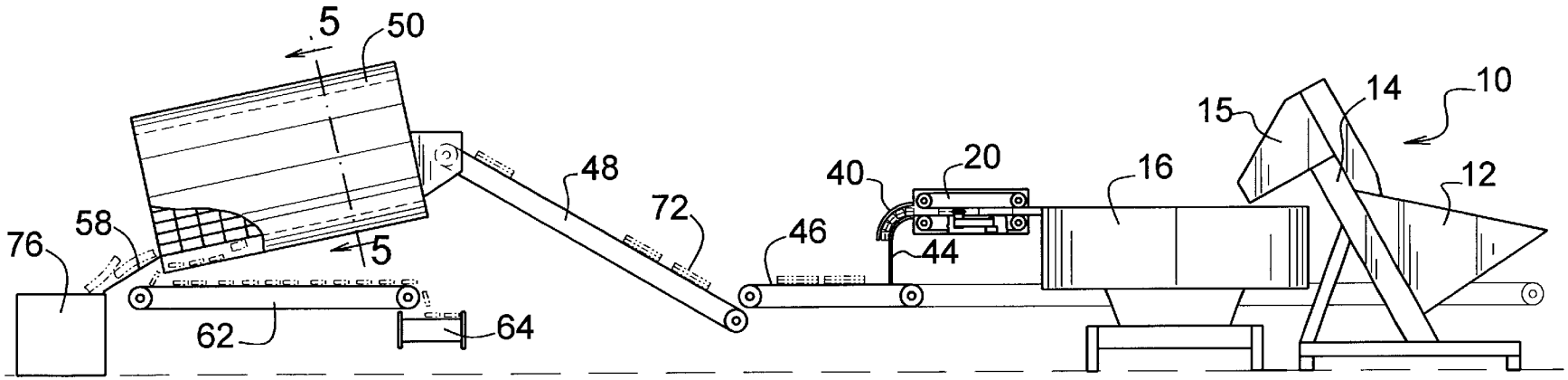
FIG. 2 is a side view of the preferred embodiment of FIG. 1.

As best shown in FIGS. 1 and 2, a system identified by the numeral 10 for automatically opening cartons and removing packages from the carton is shown. The system 10 includes a feed hopper 12 which receives unopened cartons of cigarettes, the cartons generally being glued closed and in many instances include a polypropylene film overwrap. An inclined discharge conveyor 14 is located on one side of the carton dump bin 12 to convey the unopened cartons from the dump bin 12 into an orientation bowl 16 which is generally a centrifugal bowl which spends to align the cartons along the inner surface of the turning bowl thereby aligning the cartons lengthwise for feeding into a feeder apparatus. One preferred commercially available orientation bowl 16 is a centrifugal feeder, FT-50, manufactured by the Hoppmann Corporation. The discharge conveyor 14 is also provided with a chute 15 on its upper discharge end for feeding the unopened cartons into the spinning orientation bowl 16.

Figure 3:
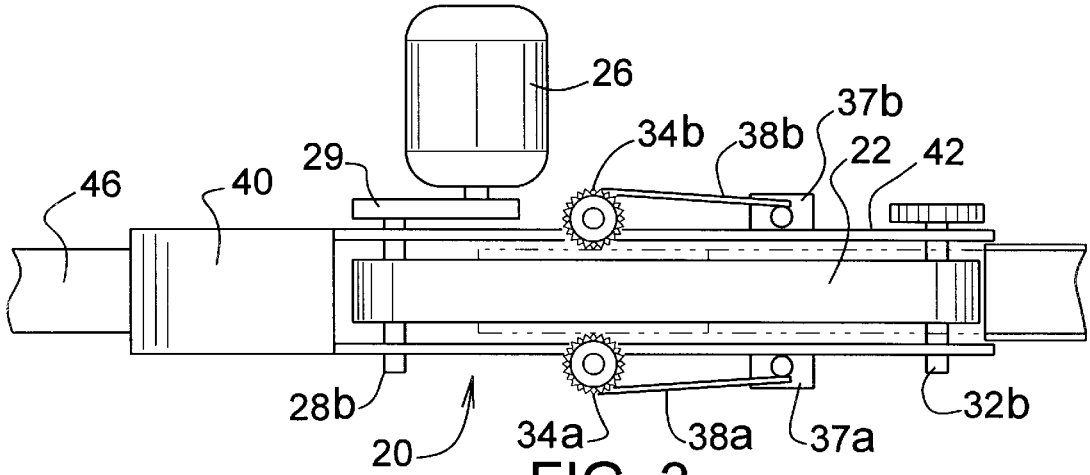
FIG. 3 is an enlarged top view of a carton opening device of the preferred embodiment of FIG. 1.
Figure 4:
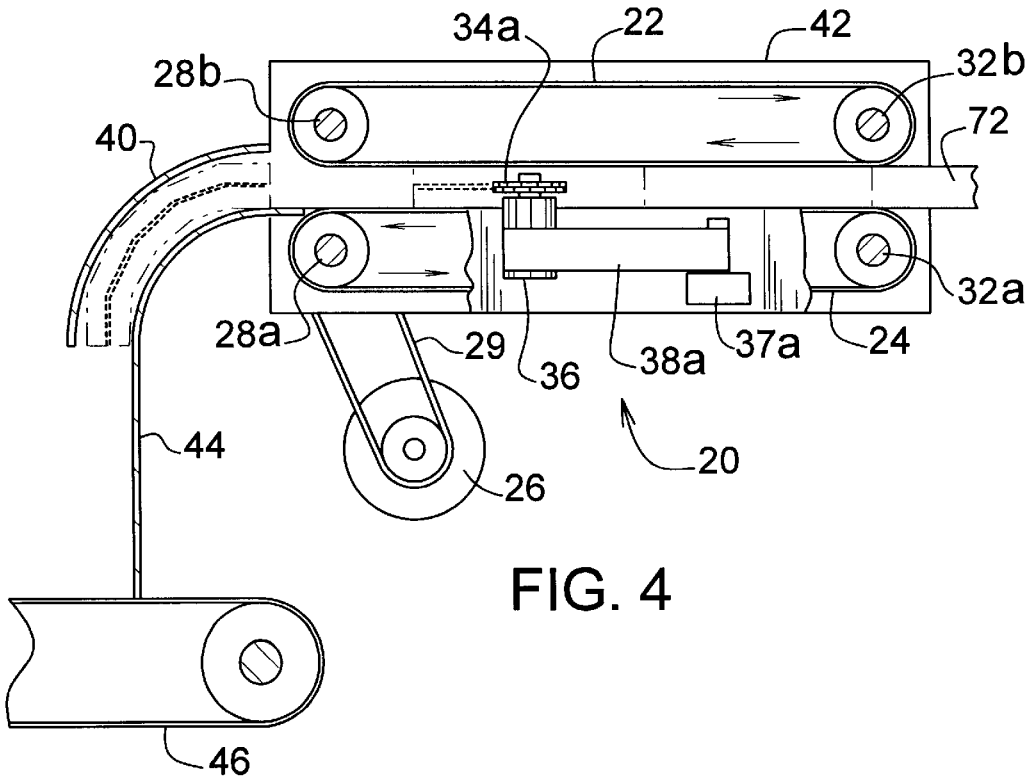
FIG. 4 is a side view of FIG. 3.

The orientation bowl 16 is provided with a tangentially positioned bowl discharge chute 18 having an inlet opening sized to receive cartons in a specific orientation. Chute 18 is connected to and provided with an outlet in alignment with the feed end of a slitting apparatus identified by the numeral 20. The slitting apparatus 20, as best shown in FIGS. 3 and 4, is provided with a housing 42 for a pair of spaced endless conveyor belts 22 and 24, the spacing being substantially the same as the thickness of a carton 72 to be received therebetween and moved through the slitting apparatus 20. The endless conveyors 22 and 24 are driven by belt drives 29 which are, in turn, driven by motor 26, the belt drives 29 turning the drive shafts 28*a* and 28*b* for the endless conveyors 22, 24, respectively. The conveyors 22 and 24 are also provided with idler shafts 32*a* and 32*b* respectively at the opposed ends from the drive shafts 28*a* and 28*b*. The slitting apparatus 20 is also provided with a pair of rotatably mounted circular cutting blades 34*a* and 34*b* which are disposed on opposite sides of the slitter and are spaced approximately the width of the cartons to be passed therebetween.

Cutting blades 34*a* and 34*b* are motor driven, only one being shown, that being motor 36 for driving cutter 34*a*. The motors 36 and the cutters 34*a*, 34*b*, are mounted onto a compression spring identified as 38*a* in FIG., 4 for the motor 36 and 38*b* in FIG. 3 for the motor (not shown) which drives the cutting blade 34*b*. Mounting assemblies 37*a* and 37*b* are provided for mounting the springs 38*a* and 38*b*, respectively, to the sides of the slitter housing 42. At the discharge end of the slitting apparatus 20 is a carton breaker device 40, which is shown as an elbow, which receives the slit cartons 72 from the slitting apparatus 20 and forces the cartons to break open as the cartons travel through the elbow and turn downwardly to drop onto conveyor 46. A vertically extending plate 44 which extends downwardly from the inner end of the elbow 40 provides a guide plate to guide the opened cartons 72 as they fall onto the horizontally extending transport conveyor 46.

Referring back to FIGS. 1 and 2, the conveyor 46 feeds an inclined tumbler feed conveyor 48 which feeds the opened cartons 72 to a tumbling cylinder 50 wherein the packages 70 are separated from the carton 72.

Figure 5:
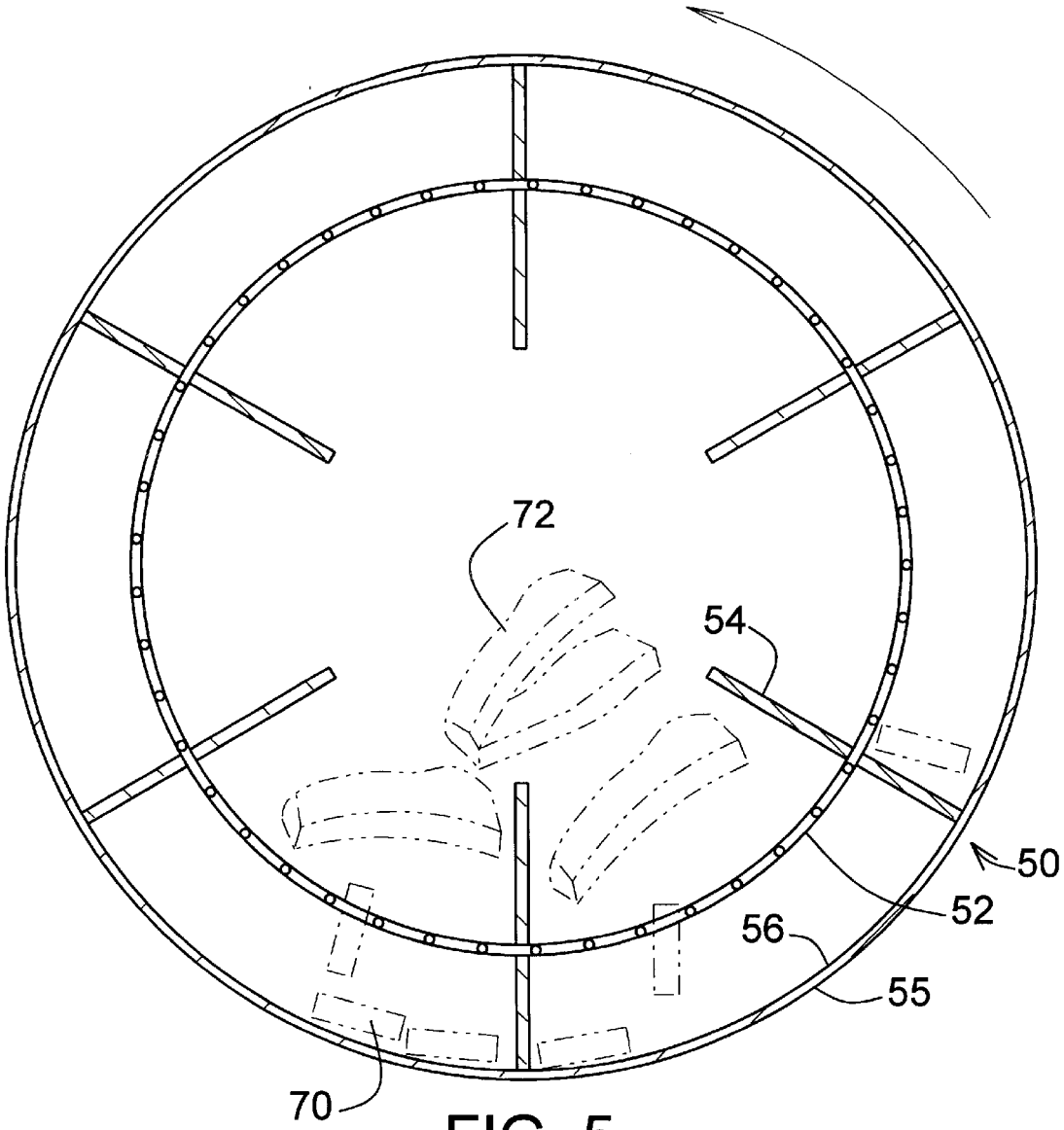
FIG. 5 is an enlarged sectional view of a rotating separating cylinder taken along lines 5—5 of FIG. 1.
Figure 6:
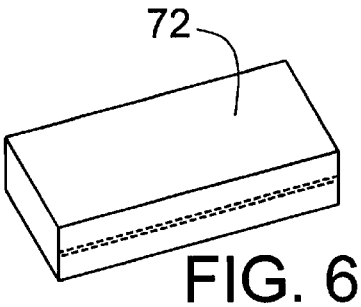
FIG. 6 is a perspective view of a carton of packages to be opened in the preferred embodiment; and, FIG. 7 is a perspective view of a carton of packages with selected portions cut-away.
Figure 7:
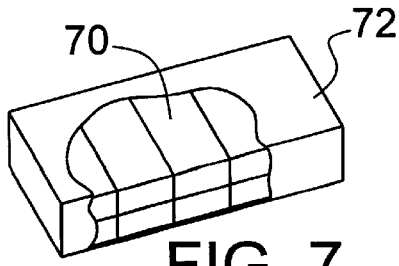

As shown in FIG. 5, the tumbling cylinder 50 is provided with a housing having an outer surface 55 and an inner surface 56 with an inner screen 52 spaced inwardly from the inner surface 56. The screen 52 is provided with openings of preselected size sufficient to receive the packages 70 therethrough but retains the opened, emptied cartons 72 and the polyethylene film wrappers thereon. A plurality of inwardly extending paddles 54 are circumferentially spaced along the inner surface 56 of the rotating drum 50 which assist in further opening up of the cartons 72 and dislodging the packs 70 from the tumbling cartons.

Referring again back to FIGS. 1 and 2, a waste carton discharge chute 58 is in alignment with the inner surface of the screen 52 to receive the emptied cartons and wrapper film therein, discharge chute 58 feeding waste drum or bin 76. A package return conveyor 62 receives the packages of cigarettes that have passed through the screen 50. A cross conveyor 64 is provided to feed the packages from the package return conveyor 62 to a cigarette package opening system for a tobacco recovery section of a cigarette manufacturing plant.

Also shown in FIGS. 1 and 2, is a system for handling previously opened or partially opened cartons and single packages of cigarettes for further processing in a cigarette package opening system. As shown, an individual package and opened carton conveyor 66 is provided and is generally mounted parallel to the orientation bowl 16 and slitting apparatus 20 as previously described. The packages 70 and opened cartons 72 are transported along the horizontally extending conveyor 66 to an inclined conveyor 68 which is parallel to and aligned with the tumbler feed conveyor 48 for the tumbler 50. Inclined conveyor 68 also feeds the individual packages 70 and the opened cartons 72 into the rotating cylinder 50.

In the operation of the system for automatically opening cartons, particularly cartons containing packages of cigarettes in accordance with the system shown in FIGS. 1 and 2, the preferred system is comprised of two infeed conveying lines, one being for returned products including those cartons of cigarettes received from the retailers or other distribution sources which are in an unopened condition and the second line being for cartons having previously been opened and individual packages of cigarettes. In the conveying line containing opened cartons and loose packages, the opened cartons are dumped onto the horizontally extending endless conveyor 66 which feeds an inclined conveyor 68 which in turn feeds the opened cartons and loose packages into the feed end of a tumbling cylinder separator 50. In parallel with the conveying line for feeding the opened cartons and loose packages is a feed hopper 12 in which unopened cartons of cigarettes are dumped and an inclined conveyor 14 which picks up the unopened cartons and transports them into an orientation cylinder 16. Orientation cylinder 16 is a centrifugal bowl and upon spinning aligns the cartons lengthwise wherein the aligned cartons are fed to a slitting apparatus 20 with the cartons being slit along their sides. The opened cartons are then conveyed to a breaker 46 which breaks the cartons apart therefore loosening the packages inside the carton and simultaneously the cartons fall by gravity onto a horizontally extending conveyor 46. The conveyor 46 transports the opened cartons to an inclined feed conveyor 48 which feeds the opened cartons to a tumbling separating cylinder 50. The cartons from the inclined conveyor 68 and the inclined conveyor 48 are tumbled throughout the cylinders 50 wherein the cartons and the plastic film are maintained on the inside of a screen 52 and the packages 70, upon being removed from the cartons 72, fall through openings in the screen 52 and are discharged onto a conveyor 62. Conveyor 62 transports the packages of cigarettes to a cigarette package opening section for opening the packages and removing the tobacco therefrom for future processing. The carton wrappers as well as the wrapper film is removed by a chute 58 into a bin or drum 76 or the like and then sent to waste.

It is realized that various changes in the details, materials of construction, steps and arrangements of parts which have been described herein are shown in the drawings in order to explain the nature of the invention, and various changes may be made by those skilled in the art without departing from the principals and scope of the invention as expressed in the claims appended hereto.

What is claimed is:

1. A system for automatically opening cartons and removing packages from the cartons comprising:

(a) first conveying means to feed closed cartons to a carton orientation means;

(b) carton orientation means;

(c) second conveying means positioned to remove cartons from said carton orientation means;

(d) carton opening means in cooperating relation with said second conveying means;

(e) third conveying means downstream from said second conveying means and in flow communication with said second conveying means; and, (f) means to separate packages from opened cartons in flow communication with a discharge of said third conveying means.

2. The system of claim 1, said carton orientation means including a centrifugal bowl having a central opening therein to receive said cartons and a discharge along the inner surface with a tangentially positioned opening of a size to receive cartons in a specific orientation.

3. The system of claim 1, said second conveying means including means to feed closed cartons in a preselected orientation.

4. The system of claim 1, said carton opening means including a slitting apparatus, said slitting apparatus including a pair of spaced endless conveyors having a feed end in flow communication with means to feed orientated cartons to said slitting apparatus, the spacing between said endless conveyors being substantially the same as the thickness of the cartons to be received therebetween, said slitting apparatus further including a pair of spaced rotatably mounted circular cutters on opposed sides of and between said spaced conveyors, the spacing between said cutters being substantially the same as the width of the cartons received therebetween.

5. The system of claim 4 including a carton breaker means attached to the discharge end of said slitting apparatus, said carton breaker means receiving opened cartons therein whereby said breaking means breaks said cartons apart.

6. The system of claim 5, said carton breaker means being a breaker device including an elbow having a horizontally extending feed end attached to said slitting apparatus and a vertically extending discharge end turned downwardly therefrom.

7. The system of claim 1 further comprising an opened carton conveying means parallel with said third conveying means, said opened carton conveying means feeding said means to separate packages from said opened cartons.

8. The system of claim 1, said means to separate packages from opened cartons comprising a rotatable drum positioned to receive opened cartons therein, said rotatable drum including means to separate packages from said opened cartons, said means to separate packages from said opened cartons including an inner screen spaced a preselected distance from the inner surface of a housing of said rotatable drum, said screen having openings therein of preselected size to receive packages removed from the cartons therethrough.

9. In a system for automatically opening cartons and removing packages from the cartons, an improvement comprising: means to feed closed cartons in a preselected orientation to a slitting apparatus, said slitting apparatus including a pair of spaced endless conveyors having a feed end in flow communication with means to feed orientated cartons to said slitting apparatus, the spacing between said endless conveyors being substantially the same as the thickness of the cartons to be received therebetween, said slitting apparatus further including a pair of spaced rotatably mounted circular cutters on opposed sides of and between said spaced conveyors, the spacing between said cutters being substantially the same as the width of the cartons received therebetween; and a carton breaker means attached to a discharge end of said slitting apparatus, said carton breaker means being a breaker device including an elbow having a horizontally extending end attached to said slitter device and a vertically extending discharge end turned downwardly therefrom said breaker device receiving opened cartons therein whereby said breaking means breaks said cartons apart.

* * * * *